United States Patent [19]

Batten

[11] 4,423,797

[45] Jan. 3, 1984

[54] LADDER LEVELING DEVICE

[76] Inventor: Lloyd E. Batten, Plantation Acres, Inc., Lot #3, Hephzibah, Ga. 30815

[21] Appl. No.: 344,767

[22] Filed: Feb. 1, 1982

[51] Int. Cl.[3] ..... E06C 7/44

[52] U.S. Cl. ..... 182/204; 182/111

[58] Field of Search ..... 182/204, 205, 220, 228, 182/107, 108, 201, 202, 111

[56] References Cited

U.S. PATENT DOCUMENTS

| | | | |
|---|---|---|---|
| 2,466,838 | 4/1949 | Buell | 182/220 |
| 2,830,852 | 4/1958 | Fritz | 182/204 |
| 3,428,147 | 2/1969 | Gordon | 182/204 |
| 3,474,883 | 10/1969 | Weis | 182/204 |

FOREIGN PATENT DOCUMENTS

| | | | |
|---|---|---|---|
| 6614268 | 4/1967 | Netherlands | 182/204 |

*Primary Examiner*—Reinaldo P. Machado

*Attorney, Agent, or Firm*—Larry Harold Kline

[57] ABSTRACT

A device for leveling a ladder is disclosed which comprises a leveler guide with a hollow section which is secured to the lower portion of the ladder, a leveler leg which is sized and shaped to fit within the hollow section of the leveler guide, a plurality of guide openings spaced apart a pre-determined distance extending horizontally through the hollow portion of the leveler guide, a plurality of leg openings spaced apart a predetermined distance extending horizontally through the leveler leg, and a securing apparatus sized and shaped to fit through the plurality of guide openings and through the plurality of leg openings in order to rigidly secure the device to the ladder.

11 Claims, 9 Drawing Figures

LADDER LEVELING DEVICE

This invention relates to a leveling device and more particularly to a leveling device which can be attached to a ladder in order to level the ladder.

Whenever a ladder is placed against a structure or in a work area, the likelihood is that the surface being worked upon will not be totally level. When working on a ladder which is not secured onto a level surface, the worker increases the possibility of having an accident of some manner. The work becomes dangerous and less efficient. The present invention solves those problems and provides a leveling method and device for the ladder.

An object of the present invention is to provide a ladder leveling device which can be secured to the leg of a ladder in order to level the ladder.

Another object of the present invention is to provide a ladder leveling device in which a device can be attached to each leg of a ladder in order to aid in the leveling of the ladder.

A further object of the present invention is to provide a ladder leveling device in which a ladder can be raised or lowered incrementally in order to level the ladder.

Still another object of the present invention is to provide a ladder leveling device which can be secured to the leg of a ladder no matter what the structure or design of the leg of the ladder.

Another object of the present invention is to provide a ladder leveling device which can be secured to the bottom of a ladder having an I-beam design ladder leg member.

Still another object of the present invention is to provide a ladder leveling device which can be utilized to level a ladder no matter what surface the ladder is resting upon.

Another object of the present invention is to provide a ladder leveling device which can be attached to a ladder without interfering with the functional use of the ladder.

A further object of the present invention is to provide a ladder leveling device which can be secured to the ladder in a plurality of ways.

These and other objects and features of the invention will be apparent from the following description and appended claims.

Briefly, the invention is a device for leveling a ladder comprising a leveler guide with a hollow section secured to the lower portion of the ladder. A leveler leg is sized and shaped to fit within the hollow section of the leveler guide. A plurality of guide openings is spaced apart a pre-determined distance extending horizontally through the hollow portion of the leveler guide. A plurality of leg openings is spaced apart a pre-determined distance extending horizontally through the leveler leg. Securing means is sized and shaped to fit through one of the plurality of guide openings and through one of the plurality of leg openings when the leveler leg is placed within the hollow section of the leveler guide. The securing means is operative to secure the leveler leg rigidly to the leveler guide and, thereby, to the ladder.

Foot means may be removably secured to the leveler leg. The foot means is operable to connect the leveler leg to the surface upon which the ladder is resting. The foot means may be connected in a swivel manner to the leveler leg. The leveler leg may have a clearance opening in the bottom of the leveler leg in order to provide clearance for the foot means which may require such clearance in order to be removably attached in a swivel manner to the leveler leg.

Each of the plurality of leg openings may be spaced apart the same pre-determined distance. Each of the plurality of guide openings may be spaced apart at pre-determined distances which are not equal.

Each of the plurality of leg openings may be spaced apart the pre-determined distance of one inch. The plurality of guide openings may comprise four guide openings which are consecutively spaced apart one-half inch, three-quarters inch, and one-half inch.

The leveler guide may comprise an outer portion which is secured to the lower portion of the ladder. The leveler guide may comprise an inner portion which forms a portion of the inner wall of the hollow section and isolates the leveler leg from the lower portion of the ladder when the leveler leg is placed within the hollow section of the leveler guide.

The plurality of guide openings extends horizontally through the outer portion and the inner portion of the leveler guide. Retaining means is sized and shaped to be placed onto the securing means. The retaining means is operative to retain the securing means in a securing position and to release, when desired, the securing means whereby the position of the leveler leg can be moved as desired.

An insert adaptor is operative to be secured between the leveler guide and the lower portion of the ladder when the lower portion of the ladder is shaped in a manner that the leveler guide cannot be directly secured thereto. The lower portion of the ladder may be shaped in an I-beam configuration. When the lower portion of the ladder is shaped in an I-beam configuration, an insert adaptor is also shaped in an I-beam configuration to fit therein. The insert adaptor may be secured apart from the base of the I-beam configuration by being secured to the sides of the I-beam configuration. The insert adaptor may be secured apart from the base of the I-beam configuration by being secured to the base of the I-beam configuration through spacer means.

The invention will be more fully understood from the following detailed description and appended claims when taken with the drawings in which:

FIG. 1 is a partial elevational view of the ladder 1 with a left leveler guide 5 and a right leveler guide 6 attached thereto.

FIG. 2 is an exploded isometric view of the left leveler guide 5 secured to the left ladder side member 2, with the left leveler leg 7 and the left foot 9 exploded therefrom.

Figure 6:
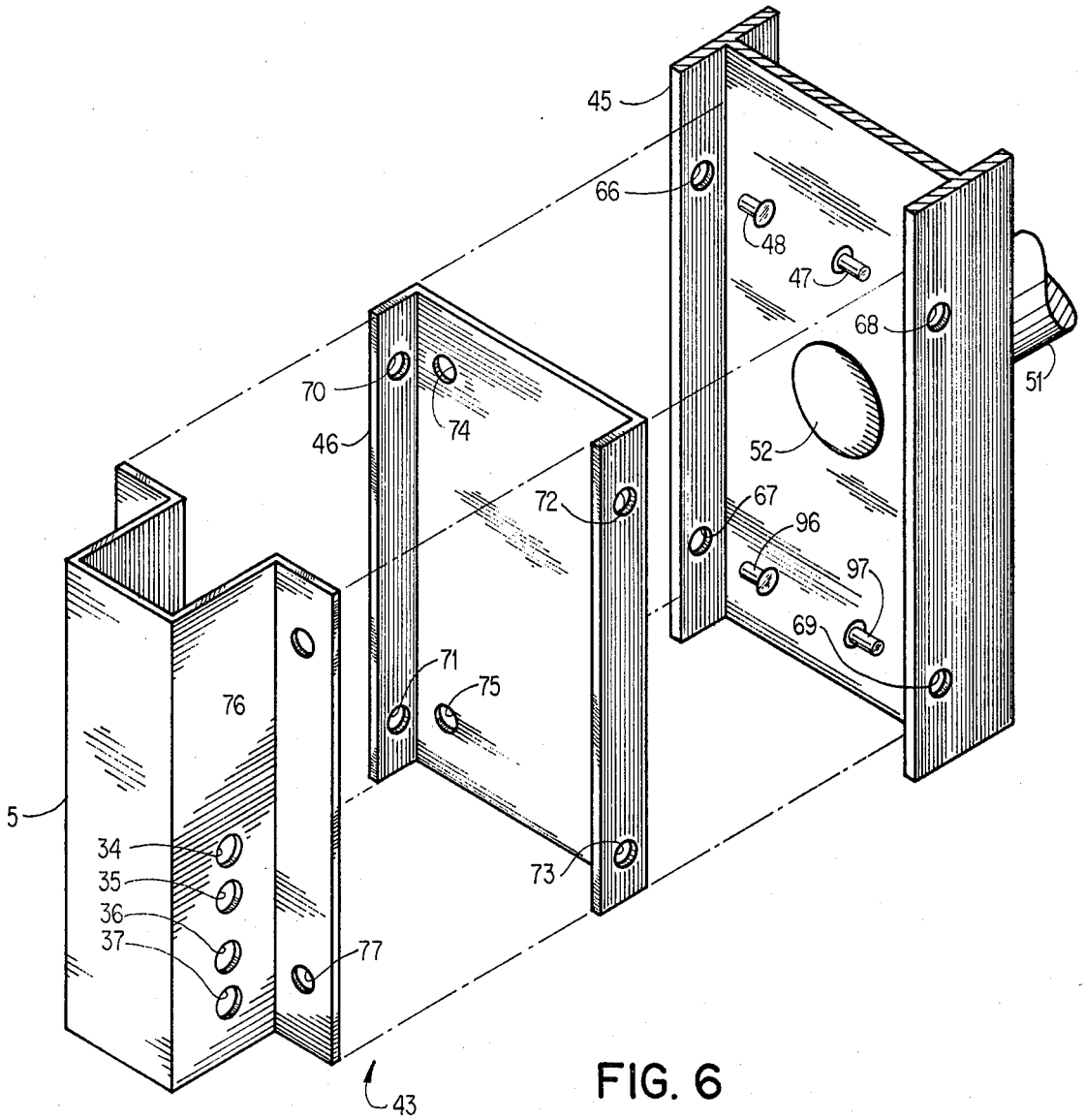

FIG. 6 is a partial exploded isometric view of the left leveler guide 5 utilized with an I-beam design ladder side member 45, utilizing side member insert 46 to secure left leveler guide 5 to I-beam design ladder side member 45.

Figure 7:
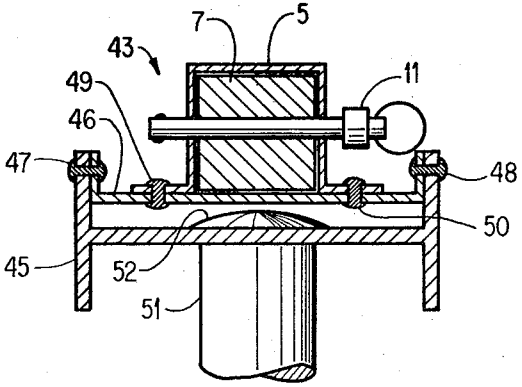

FIG. 7 is a top sectional view of the left leveler guide 5 utilized with an I-beam design ladder side member 45, utilizing side member insert 46 to secure left leveler guide 5 to I-beam design ladder side member 45, all parts being secured together.

Figure 8:
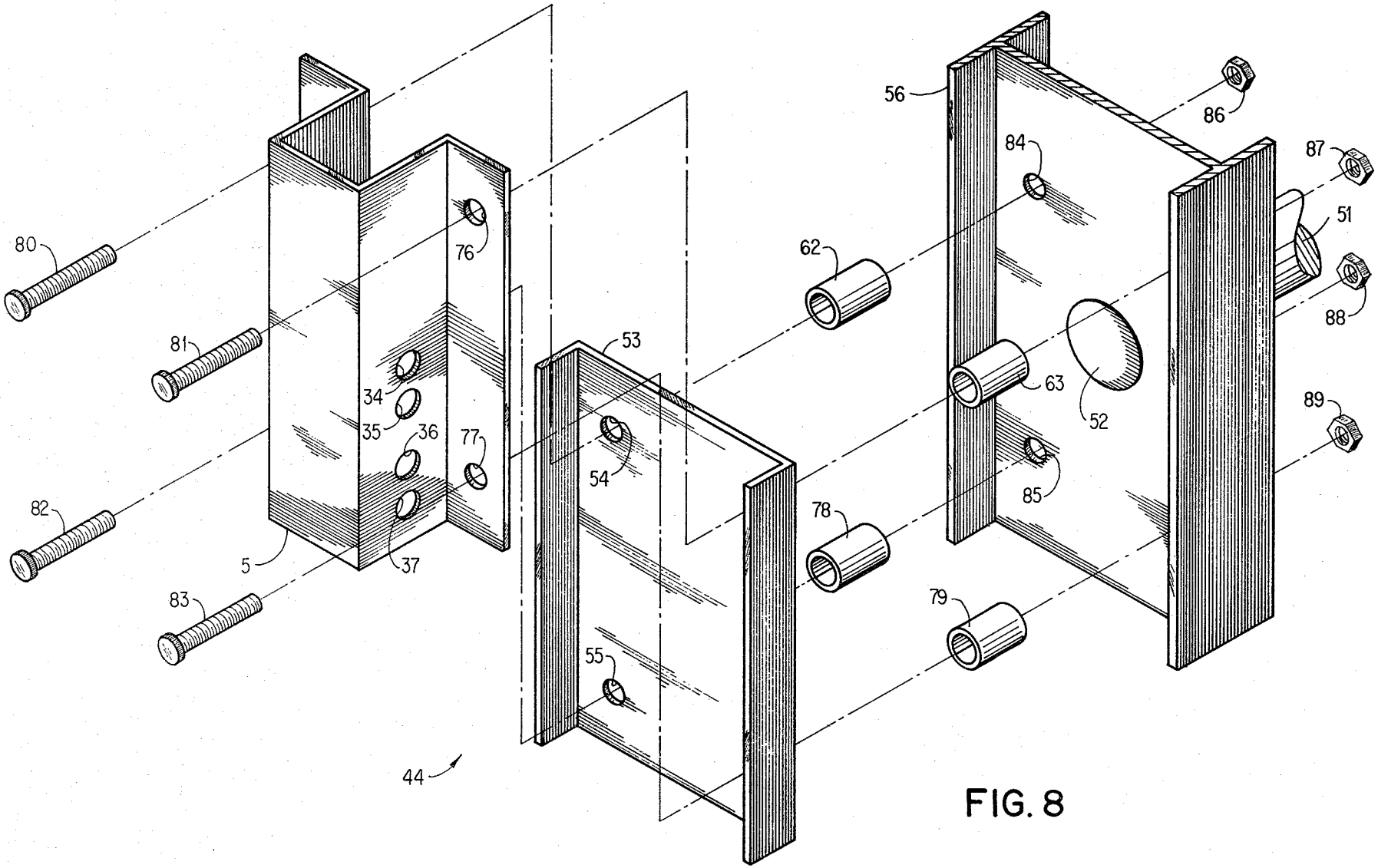

FIG. 8 is a partial exploded isometric view of the left leveler guide 5 utilized with an I-beam design ladder side member 56, utilizing side member insert 53 to secure left leveler guide 5 to I-beam design ladder side member 56.

Figure 9:
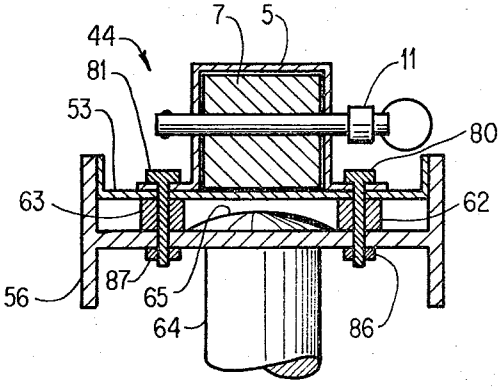

FIG. 9 is a top sectional view of the left leveler guide 5 utilized with an I-beam design ladder side member 56, utilizing side member insert 53 to secure left leveler guide 5 to I-beam design ladder side member 56, all parts being secured together.

Figure 1:
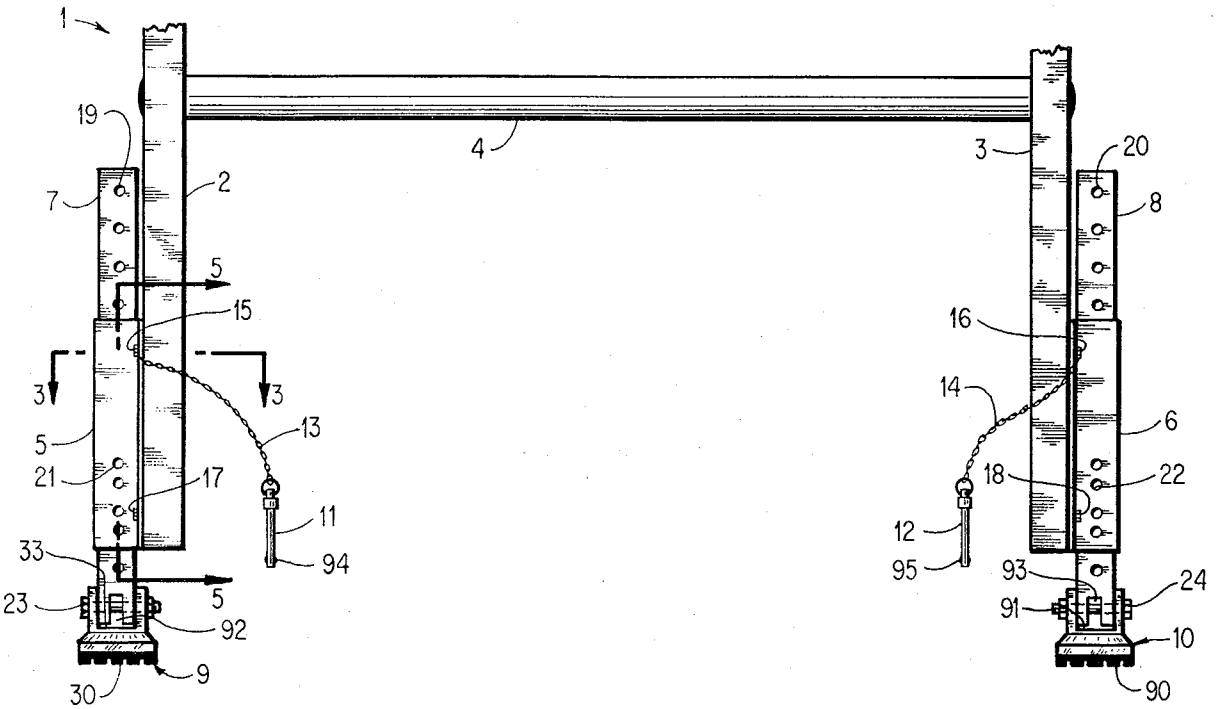

Referring now to the drawings, FIG. 1 is a partial elevational view of the ladder 1 with a left leveler guide 5 and a right leveler guide 6 attached thereto. Left leveler leg 7 extends through left leveler guide 5. Right leveler leg 8 extends through right leveler guide 6. Secured to left leveler leg 7 is a left foot 9. Secured to right leveler leg 8 is a right foot 10. Secured to left foot 9 is a gripping pad 30. Secured to right foot 10 is a gripping pad 90. Left foot 9 has a slotted portion 33. Through slotted portion 33 extends foot securing means 23. Right foot 10 has a slotted portion 91. Through slotted portion 91 extends foot securing means 24.

Securing pin 11 extends through one of a plurality of adjustment holes 21 in left leveler guide 5 and through one of a plurality of adjustment holes 19 in left leveler leg 7 to secure left leveler leg 7 to left leveler guide 5 and to adjust the height of the left ladder side member 2 of ladder 1. Securing pin 12 extends through one of a plurality of adjustment holes 22 in right leveler guide 6 and through one of a plurality of adjustment holes 20 in right leveler leg 8 to secure right leveler leg 8 to right leveler guide 6 and to adjust the height of the right ladder side member 3 of ladder 1.

The bottom portion of ladder 1 is shown comprising left ladder side member 2, right ladder side member 3, and the bottom ladder rung 4 extending from left ladder side member 2 to right ladder side member 3. Chain 13 is secured to securing pin 11 and may be secured anywhere on any of the pieces of this device for convenience. Chain 14 is secured to securing pin 12 and may be secured anywhere on any of the pieces of this device for convenience.

The left leveler guide 5 may be secured to the left ladder side member 2 in any desired manner. A plurality of securing bolts may be utilized to secure the left leveler guide 5 to the left ladder side member 2. An upper right securing bolt 15 and a lower right securing bolt 17 are shown, for example, securing left leveler guide 5 to left ladder side member 2, along with other securing means, not shown.

The right leveler guide 6 may be secured to the right ladder side member 3 in any desired manner. A plurality of securing bolts may be utilized to secure the right leveler guide 6 to the right ladder side member 3. An upper left securing bolt 16 and a lower left securing bolt 18 are shown, for example, securing right leveler guide 6 to right ladder side member 3, along with other securing means, not shown.

The left leveler guide 5 and the right leveler guide 6 may be identical. The left leveler leg 7 and the right leveler leg 8 may be also identical. The device may be used on both sides of the ladder or only one side of the ladder, if desired.

Figure 2:
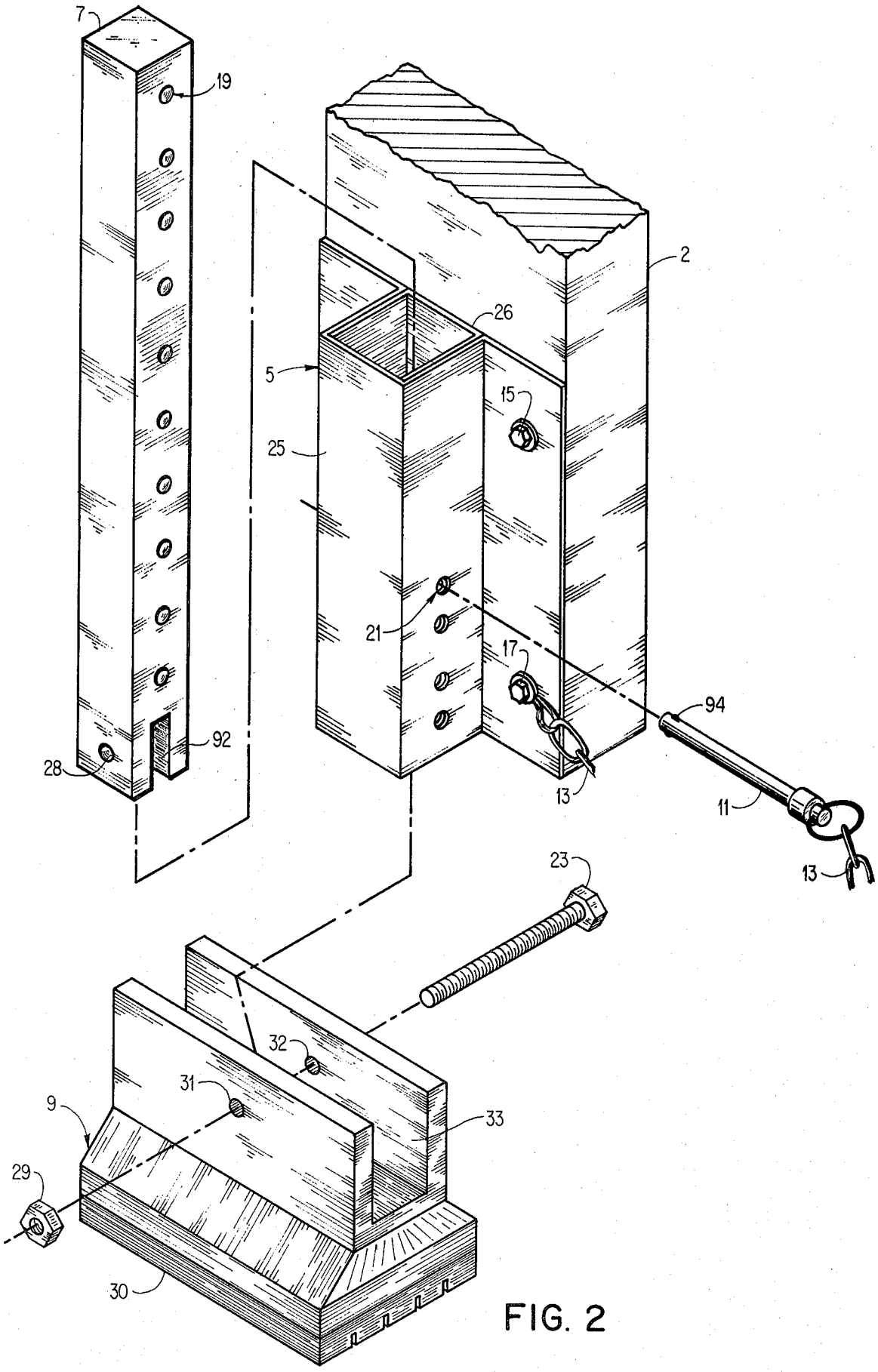

FIG. 2 is an exploded isometric view of the left leveler guide 5 secured to the left ladder side member 2, with the left leveler leg 7 and the left foot 9 exploded therefrom. Left leveler guide 5 comprises an outer portion 25 and an inner portion 26. The outer portion 25 extends around and away from the inner portion 26. The inner portion 26 may be held in place by the pressure of the outer portion 25. Left leveler guide 5 may be secured to the left ladder side member 2 by any desired securing means, including a plurality of bolts, such as upper right securing bolt 15 and lower right securing bolt 17. The securing pin 11 would extend through one of a plurality of adjustment holes 21 in left leveler guide 5. Preferably, the inner portion 26 will be rigidly secured to the outer portion 25 in some manner, such as by spot welding.

Left leveler guide 5 would have an outer wall which is part of outer portion 25 and an inner wall which is part of the inner portion 26. The inner portion 26 enables the portion of the left leveler guide 5, through which the plurality of adjustment holes 21 are placed, to have double strength. Inner portion 26 also isolates the sliding left leveler leg 7 from the left ladder side member 2 when the left leveler leg 7 is being adjusted within the left leveler guide 5.

The securing pin 11 would be placed through one of a plurality of adjustment holes 21 in left leveler guide 5 and through one of a plurality of adjustment holes 19 in left leveler leg 7. Securing pin 11 is then placed through one of a second plurality of adjustment holes (not shown) in left leveler guide 5 on the back wall of left leveler guide 5, which is on a horizontal plane with the first one of a plurality of adjustment holes 21 in left leveler guide 5. Thereby, securing pin 11 would extend completely through left leveler guide 5 and left leveler leg 7 in order to secure the left leveler leg 7 to left leveler guide 5, which is secured to left ladder side member 2, in order to adjust the height of left ladder side member 2 of ladder 1.

Left foot 9 has a slotted portion 33. In the slotted portion 33 are placed securing holes 31 and 32. Foot securing means, such as bolt 23, may be placed through the securing holes 31 and 32 in left foot 9 and into foot securing holes, such as hole 28, in left leveler leg 7 and is secured by nut 29 in order to secure the left foot 9 onto the left leveler leg 7. The left leveler leg 7 may be placed within the slotted portion 33 of left foot 9. The left leveler leg 7 may have a slotted opening 92 in order for left leveler leg 7 to utilize certain types of different feet with this device. Right leveler leg 8 is shown in FIG. 1 to have a similar opening 93. Any type of foot means may be utilized with the present device.

Figure 3:
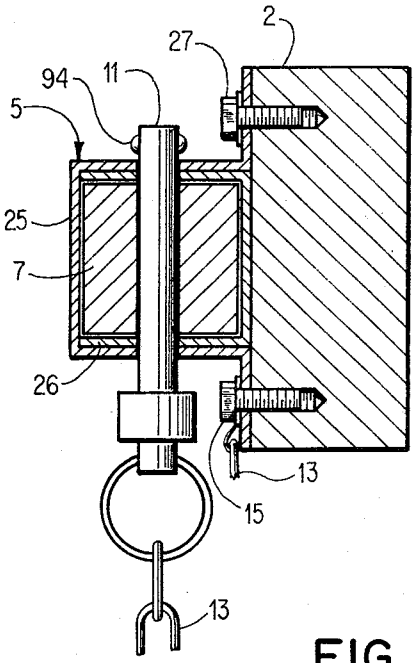
FIG. 3 is a top sectional view taken at section 3—3 of FIG. 1.

FIG. 3 is a top sectional view taken at section 3—3 of FIG. 1. FIG. 3 shows outer portion 25 of left leveler guide 5 being secured to left ladder side member 2 by upper right securing bolt 15 and upper left securing bolt 27. The securing pin 11 extends through the outer portion 25 and the inner portion 26 of left leveler guide 5 and through the left leveler leg 7, in order to secure the parts together. A retaining means 94 may be built-in or secured to the end of securing pin 11 in order to hold securing pin 11 in place until removal is desired.

As shown in FIG. 1, a retaining means 95 may be built-in or secured to the end of securing pin 12 in order to hold securing pin 12 in place until removal is desired. Chain 13 is shown attached to securing pin 11 and secured by upper right securing bolt 15 to the left leveling guide 5.

Figure 4:
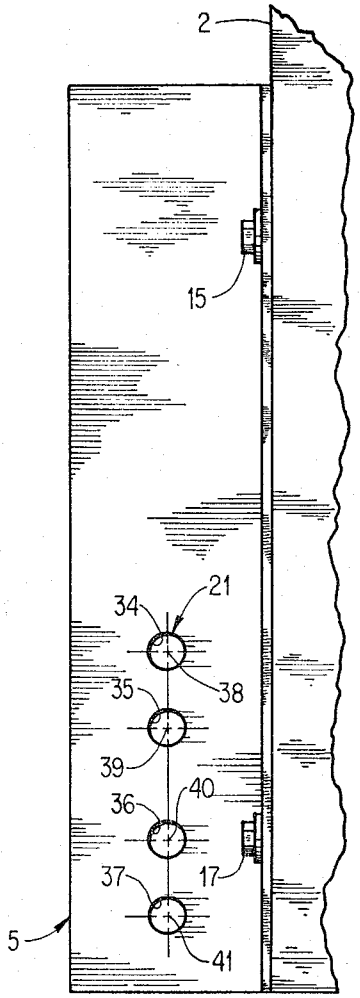
FIG. 4 is an enlarged partial elevational view of left leveler guide 5 secured to left ladder side member 2.

FIG. 4 is an enlarged partial elevational view of left leveler guide 5 secured to left ladder side member 2. In FIG. 4, the plurality of adjustment holes 21 in left leveler guide 5 is shown as a series of four holes. These holes, 34, 35, 36, and 37, are adjustment holes. For the purposes of proper adjustment of this device, the plurality of adjustment holes 21 may be specified to be a defined distance apart. By defining the distance apart, the number of holes necessary in the left leveler guide 5 may be reduced, thereby, strengthening the left leveler guide 5. The plurality of adjustment holes 21 may be specifically defined so that the center 38 of adjustment hole 34 is exactly one-half inch from the center 39 of adjustment hole 35. The center 40 of adjustment hole 36 is exactly three-fourths inch from the center 39 of adjustment hole 35. The center 41 of adjustment hole 37 is exactly one-half inch from the center 40 of adjustment hole 36. The centers of the plurality of adjustment holes 19 on left leveler leg 7 are exactly one inch apart. Any incremental change can be designed for by making the distance between each of the adjustment holes 19 one measured unit, with the distance between centers 38 and 39 and the centers 40 and 41 one-half of said unit, and the distance between centers 39 and 40 being three-fourths of said unit.

Any plurality of adjustment holes in left leveler leg 7 and left leveler guide 5 may be utilized. However, with the defined exact measurements given herein, the height may be adjusted by one-fourth increments, as desired. There will always be a matching opening in the left leveler guide 5 and the left leveler leg 7 at each one-fourth inch increment. Through that matching of openings, the securing pin 11 may be placed for the desired adjustment. Utilizing the same principle, different distances between the centers of the plurality of adjustment holes 19 in left leveler leg 7 and the plurality of adjustment holes 21 in left leveler guide 5 may produce different desired incremental adjustments.

Figure 5:
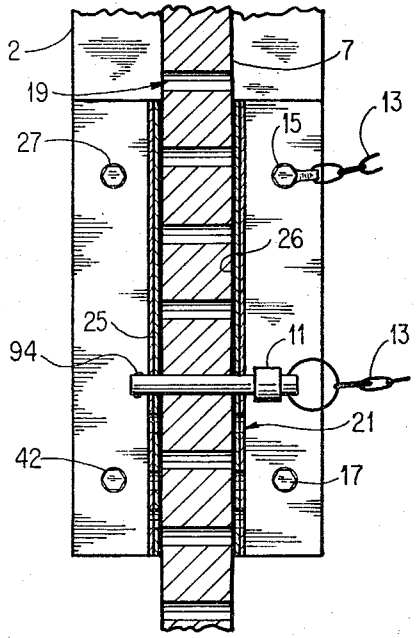
FIG. 5 is a longitudinal sectional view taken at section 5—5 of FIG. 1 with securing pin 11 inserted.

FIG. 5 is a longitudinal sectional view taken at section 5—5 of FIG. 1 with securing pin 11 inserted. The securing pin 11 is shown extending through the left leveler guide 5 and left leveler leg 7. The plurality of adjustment holes 19 in left leveler leg 7 are shown to extend through a solid piece comprising left leveler leg 7. The solid left leveler leg 7 would provide more strength for use in balancing the ladder 1. A hollowed left leveler leg 7 could be utilized with the plurality of openings being in the outer shell of the left leveler leg 7, but hollow left leveler leg 7 would not be as strong as a solid left leveler leg 7.

In this view, a plurality of four securing bolts are shown securing the left leveler leg 7 to the left ladder side member 2, upper right securing bolt 15, lower right securing bolt 17, upper right securing bolt 27, and lower left securing bolt 42.

FIG. 6 is a partial exploded isometric view of the left leveler guide 5 utilized with an I-beam design ladder side member 45, utilizing side member insert 46 to secure left leveler guide 5 to I-beam design ladder side member 45. The left leveler guide 5 and the right leveler guide 6 previously shown are identical and may be utilized not only on either side of a desired ladder, but may be utilized with any type of ladder that is desired. FIGS. 6–9 show the leveler guide and the leveler leg utilized with an I-beam design type ladder which has bottom supports or bottom lower side members which are shaped in the form of an I-beam. The invention may be utilized with any type ladder with any type lower ladder side member.

In FIGS. 6 and 7, the left leveler guide 5 is utilized, along with a side member insert 46, to secure the left leveler guide 5 in a side-mounted manner to an I-beam design ladder side member 45.

In FIGS. 8 and 9, the left leveler guide 5 is utilized, along with a side member insert 53, to secure the left leveler guide 5 in a base-mounted manner to an I-beam design ladder side member 56.

In FIG. 6, the left leveler guide 5 has an upper right opening 76 and a lower right opening 77, along with openings, not shown, for use in securing left leveler guide 5 to side member insert 46. Side member insert 46 has side openings 70, 71, 72, and 73 for use in side mounting the side member insert 46 within the I-beam design ladder side member 45. Side member insert 46 has base openings 74 and 75 and others, not shown, to aid in connecting left leveler guide 5 to side member insert 46.

Guide securing means 49 extends through upper right opening 76 in left leveler guide 5 to secure to an opening, not shown, in side member insert 46. Connecting means extends through lower right opening 77 in left leveler guide 5 to secure to an opening, not shown, in side member insert 46.

Guide securing means 50 extends through an upper left opening, not shown, in left leveler guide 5 to secure to an upper left opening 74 in side member insert 46. Connecting means extends through lower left opening, not shown, in left leveler guide 5 to secure to lower left opening 75 in side member insert 46.

I-beam design ladder side member 45 has side openings 66, 67, 68, and 69 for use in the side mounting to connect side member insert 46 to I-beam design ladder side member 45. Member insert securing means 48 passes through side opening 70 in side member insert 46 and opening 66 in ladder side member 45 to aid in securing side member insert 46 to ladder side member 45.

Lower left member insert securing means 96 passes through side opening 71 in side member insert 46 and opening 67 in ladder side member 45 to aid in securing side member insert 46 to ladder side member 45. Upper right member insert securing means 47 passes through side opening 72 in side member insert 46 and opening 68 in ladder side member 45 to aid in securing side member insert 46 to ladder side member 45. Lower right member insert securing means 97 passes through side opening 73 in side member insert 46 and opening 69 in ladder side member 45 to aid in securing side member insert 46 to ladder side member 45.

Ladder leveling device 43 is utilized on an I-beam design ladder side member 45 in which the side member insert 46 is secured to the I-beam design ladder side member 45 in a side mounting.

As shown in FIG. 7, the side member insert 46 is mounted in a manner that the side member insert 46 does not interfere with rung cap 52 on ladder rung 51.

FIG. 7 is a top sectional view of the left leveler guide 5 utilized with an I-beam design ladder side member 45, utilizing side member insert 46 to secure left leveler guide 5 to I-beam design ladder side member 45, all parts being secured together. As shown in this top sectional view, the side member insert 46 is clear of the rung cap 52 on ladder rung 51. The side member insert 46 is secured to the I-beam design ladder side member 45 in a side mounting.

FIG. 8 is a partial exploded isometric view of the left leveler guide 5 utilized with an I-beam design ladder side member 56, utilizing side member insert 53 to secure left leveler guide 5 to I-beam design ladder side member 56. The ladder leveling device 44 shown in FIGS. 8 and 9 is for use on an I-beam design ladder side member 56 in which the side member insert 53 is base mounted to the I-beam design ladder side member 56 utilizing spacers to prevent the side member insert 53 from interfering with the rung cap 65 on ladder rung 64. A bolt 81 extends through upper right opening 76 in left leveler guide 5, through an opening, not shown, in side member insert 53, and through spacer 63, and through an opening, not shown, in I-beam design ladder side member 56, to be secured by nut 87 to aid in securing all parts together.

A bolt 80 extends through an upper left opening, not shown, in left leveler guide 5, through an upper left opening 54 in side member insert 53, through spacer 62, and through upper left opening 84 in I-beam design ladder side member 56, to be secured by nut 86 to aid in securing all parts together.

A bolt 83 extends through lower right opening 77 in left leveler guide 5, through a lower right opening, not shown, in side member insert 53, through spacer 79, and through a lower right opening, not shown, in I-beam design ladder side member 56, to be secured by nut 89 to aid in securing all parts together.

A bolt 82 extends through a lower left opening, not shown, in left leveler guide 5, through a lower left opening 55 in side member insert 53, through spacer 78, and through lower left opening 85 in I-beam design ladder side member 56, to be secured by nut 88 to aid in securing all parts together.

FIG. 9 is a top sectional view of the left leveler guide 5 utilized with an I-beam design ladder side member 56, utilizing side member insert 53 to secure left leveler guide 5 to I-beam design ladder side member 56, all parts being secured together. As can be noted, utilizing the base method of securing the side member insert 53 to the I-beam design ladder side member 56, the spacers 62, and 63, and other spacers, not shown, will prevent interference by the side member insert 53 and the rung cap 65 of ladder rung 64.

In attaching the ladder leveling device 43, ladder leveling device 44, or the initial ladder leveling device shown with a basic ladder bottom, the same basic leveler guide, leveler leg, foot attachment, and securing means may be utilized. Certain adapting pieces, such as the side member insert 46 or side member insert 53, may be utilized to secure different shaped ladder bottoms or to secure portions together without interfering with the basic ladder functions. All attachments of the ladder leveling device to the ladder are in a manner so that the basic function of a ladder, including an extension ladder, can be fulfilled without interference.

The present invention provides a ladder leveling device which can be secured to either one leg of a ladder or both legs of a ladder in order to level the ladder. The invention provides a ladder leveling device which allows a ladder to be raised or lowered incrementally in order to level the ladder. The ladder leveling device may be secured to the leg of a ladder no matter what the structure or design of the leg of the ladder. The ladder leveling device may be utilized to level a ladder no matter what type of surface the ladder is placed upon. Since the ladder leveling device may be secured to a ladder in a plurality of ways, the device may even be used with a ladder having an I-beam ladder leg member.

The attachment means for attaching the leveler guides to the ladder side members are attached in such a manner as to not interfere with any function of the ladder. Spacers may be utilized at any attachment point to prevent interference from any part of the device. Any type of foot or leveling foot may be utilized on the ladder leveling device disclosed herein. The ladder leveling device may be manufactured in any way desired. The leveling guide may be constructed of one piece or could be made with the outer portion 25 and the inner portion 26 fabricated separately. The leveler leg may be solid or a hollow piece. The leveler guide may have a double thickness or more for strength purposes or may be a single thickness, if desired.

The ladder leveling device can be mounted on any ladder, including even small ladders. The leveling guide may be as wide as the leg of the ladder or smaller than the width of the leg of the ladder. The leveling guide and the leveling leg may be any width or length desired.

Feet attached to the leveling legs may be interchangeable. Rivets may be used on the inside of the ladder to secure the leveling guide to the ladder or any other type of securing means may be utilized.

The leveling guide and the leveling leg may have any desired plurality of openings. The openings may be designed so that the ladder leveling device may be changed incrementally at any desired increment of change.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for leveling a ladder comprising:

a. a leveler guide with a hollow section secured to the lower portion of said ladder;

b. a leveler leg sized and shaped to fit within said hollow section of said leveler guide;

c. a plurality of guide openings spaced apart a predetermined distance comprising four guide openings which are consecutively spaced apart one-half inch, three-quarters inch, and one-half inch extending horizontally through said hollow portion of said leveler guide;

d. a plurality of leg openings spaced apart a pre-determined distance of one inch extending horizontally through said leveler leg; and e. securing means sized and shaped to fit through one of a plurality of guide openings and through one of said plurality of leg openings when said leveler leg is placed within said hollow section of said leveler guide, and operative to secure said leveler leg rigidly to said leveler guide and, thereby, to said ladder, whereas said ladder can be raised or lowered specific distances as small as one-quarter inch in finite adjustments.

2. A device according to claim 1 further comprising foot means removably secured to said leveler leg and operative to connect said leveler leg to the surface upon which said ladder is resting.

3. A device according to claim 2 wherein said foot means is connected in a swivel manner to said leveler leg.

4. A device according to claim 3 wherein said leveler leg has a clearance opening in the bottom of said leveler leg in order to provide clearance for said foot means which may require such clearance in order to be removably attached in said swivel manner to said leveler leg.

5. A device according to claim 1 wherein said leveler guide comprises an outer portion which is secured to the lower portion of said ladder, and an inner portion which forms a portion of the inner wall of said hollow section and isolates said leveler leg from said lower portion of said ladder when said leveler leg is placed within said hollow section of said leveler guide.

6. A device according to claim 5 wherein said plurality of guide openings extends horizontally through said outer portion and said inner portion of said leveler guide.

7. A device according to claim 1 further comprising retaining means, sized and shaped to be placed onto said securing means, and operative to retain said securing means in a securing position and to release, when desired, said securing means whereby the position of said leveler leg can be moved as desired.

8. A device according to claim 1 further comprising an insert adaptor operative to be secured between said leveler guide and said lower portion of said ladder when said lower portion of said ladder is shaped in a manner that said leveler guide cannot be directly secured thereto.

9. A device according to claim 8 wherein said lower portion of said ladder is shaped in an I-beam configuration and said insert adaptor is shaped to fit within said I-beam configuration.

10. A device according to claim 9 wherein said insert adaptor may be secured apart from the base of said I-beam configuration by being secured to the sides of said I-beam configuration.

11. A device according to claim 9 wherein said insert adaptor may be secured apart from said base of said I-beam configuration by being secured to the base of said I-beam configuration through spacer means.

* * * * *